United States Patent [19]

Becker, Jr.

[11] 3,991,393

[45] Nov. 9, 1976

[54] SERVOMECHANISM CONTROL CYLINDER

[75] Inventor: Howard I. Becker, Jr., Louisville, Ky.

[73] Assignee: General Electric Company, Louisville, Ky.

[22] Filed: June 2, 1975

[21] Appl. No.: 582,594

[52] U.S. Cl. ..... 336/30; 73/398 R; 336/77; 336/79; 336/84

[51] Int. Cl.[2] ..... H01F 21/02

[58] Field of Search ..... 73/398 R, 419; 336/30, 336/75, 77, 79, 87, 136

[56] References Cited

UNITED STATES PATENTS

| | | | |
|---|---|---|---|
| 1,656,381 | 1/1928 | Marvel | 336/87 |
| 2,417,097 | 3/1947 | Warshaw | 336/30 |
| 2,495,157 | 1/1950 | Browne, Jr. | 336/87 |
| 2,922,971 | 1/1960 | Jeglum | 336/30 |
| 3,160,836 | 12/1964 | Farley | 336/30 |
| 3,289,479 | 12/1966 | Tausch | 73/398 R X |

FOREIGN PATENTS OR APPLICATIONS

| | | | |
|---|---|---|---|
| 581,065 | 11/1924 | France | 336/75 |
| 28,947 | 10/1884 | Germany | 336/75 |

*Primary Examiner*—Thomas J. Kozma
*Attorney, Agent, or Firm*—Francis H. Boos

[57] ABSTRACT

An improved servomechanism control cylinder has a housing and a position feedback system contained in the housing. Movement of a piston of the control cylinder moves a shield relative to a fixed electrical coil for changing the signal delivered by the position feedback system. The delivered signal is representative of the position of the piston and can be utilized for controlling movement of the piston.

4 Claims, 2 Drawing Figures

SERVOMECHANISM CONTROL CYLINDER

BACKGROUND OF THE INVENTION

Servomechanisms have been utilized for automating movements of a work piece. A device for automatically abutting first and second sheets of steel for welding the sheets together to form a metal cabinet is an example.

In some heretofore utilized servo systems, an electrical signal is delivered which is representative of a relative position of the work piece. The signal is compared to an instructional signal and the difference between the signals, if any, is amplified and utilized to actuate power means to drive the work piece to a location at which the difference between the delivered signal and the instructional signal is substantially zero.

Electrical position feedback systems are generally of fragile construction, expensive, often bulky, and are usually constructed for direct control by rotary motion. However, the use of power cylinders is generally preferred in modern servomechanisms.

It is therefore desirable to provide a rugged, relatively inexpensive position feedback system which is directly controlled by linear motion and which is of a construction which decreases the bulk of the servo system. This is accomplished in the apparatus of this invention by utilizing the inductor of French Pat. No. 581,065 and uniquely connecting it to the piston and positioning it within the control cylinder housing.

SUMMARY OF THE INVENTION

In accordance with this invention, an improved servomechanism control cylinder has a housing, a piston movable within the chamber of the housing, an actuating element connected to the piston, means for passing fluid into the housing chamber between one end of the housing and a surface of the piston and means for passing fluid into the housing chamber between an opposed end of the housing and an opposed surface of the piston for controllably moving the piston along the length of the housing. A core element is substantially coaxially positioned within the housing chamber. An electrical coil is substantially coaxially positioned about the core element between said core element and the housing. The electrical coil is fixed relative to the housing. A shield extends about the core element between said core element and said coil. The shield is connected to the piston for movement along the electrical coil in response to movement of the piston. Means are connected to the electrical coil for delivering a signal responsive to the position of the shield relative to the electrical coil.

DETAILED DESCRIPTION OF THE INVENTION

Figure 1:
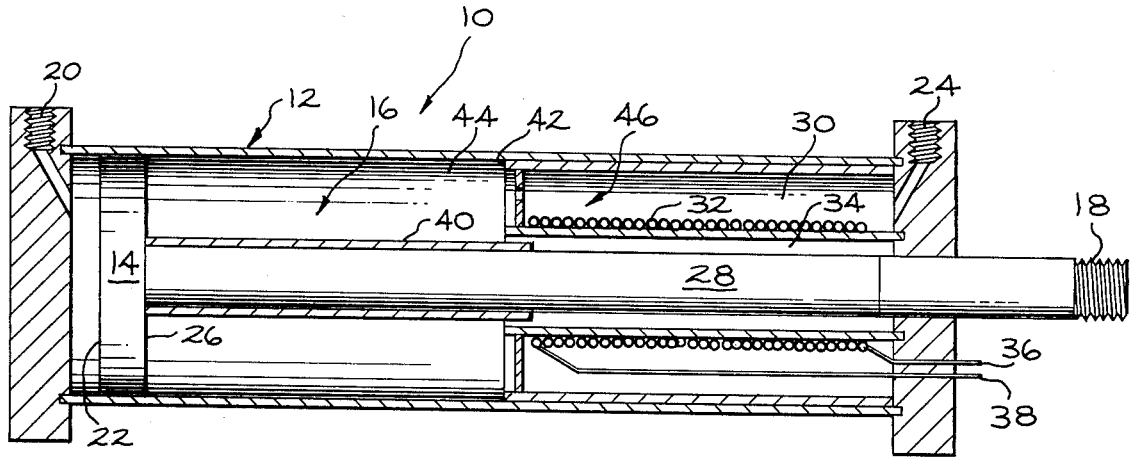
FIG. 1 is a diagrammatic, partially sectioned view of one embodiment of the improved cylinder of this invention.

In the embodiment of FIG. 1, a control cylinder 10 has a housing 12, a piston 14 that is movable within a chamber 16 of the housing 12, and an actuating element 18 connected to the piston 14 by virtue of an intermediate core 28. Means, such as a port 20, is provided for passing fluid into and from the housing chamber 16 between one end of the housing 12 and a first end 22 of the piston 14. Means, such as port 24, is provided for passing fluid into and from the housing chamber 16 between an opposed end of the housing 12 and a second end 26 of the piston 14. Passing of fluid into and from the chamber through ports 20, 24 controls the movement of the piston 14 along the length of the housing 12 and the positioning of the actuating element 18 relative to the housing 12, as is known in the art.

A core element 28 is attached at one end to the piston 14 and at the other end to actuating element 18 and is formed of, for example, steel is positioned within the housing 12, extends along the axis of the chamber 16, and forms an annulus 30 between the core element 28 and the walls of the housing 12. The core is generally the same length as the housing 12.

An electrical coil 32 is substantially, coaxially positioned about the core element 28 within the housing 12. The coil 32 forms a first annulus 34 between the electrical coil 32 and the core element 28 and a second annulus 46 between the coil 32 and the housing element 12. The electrical coil 32 is fixed relative to the housing 12 and is adjacent one end of the cylinder and generally about one-half the length of the core element 28.

A shield 40 formed of, for example, copper extends about and along one half the length of the core element 28 within the housing 12. The shield 40 is positioned about the core 28 in the first annulus 34 and associated with the piston 14 for movement along the electrical coil 32 in response to movement of the piston 14.

The coil 32 has first and second power leads 36, 38 extending through the housing for delivering a signal responsive to the relative position of the shield 40 to the coil 32.

In the embodiment of FIG. 1, the core element 28 and the shield 40 are connected to a common surface or end 26 of the piston 14. In this embodiment, the core element 28 extends along the housing chamber axis and is connected to the actuating element 18 for extending and retracting the actuating element from and toward the housing and the shield 40 relative to the electrical coil 32 in response to movement of the piston 14.

It should be understood that the core element 28 and the actuating element 18 can be formed as a unitary element by providing an actuating portion such as machined threads thereon. A piston stop element 42 can be positioned between first and second housing end portions 44, 46 in the pathway of the piston 14 moving through the housing 12 for preventing the piston 14 from damaging the electrical coil 32. The stop element can be a tubular member fixedly connected to one end of the housing and extending coaxially through the second annulus 48 formed between the electrical coil and the housing 12.

Figure 2:
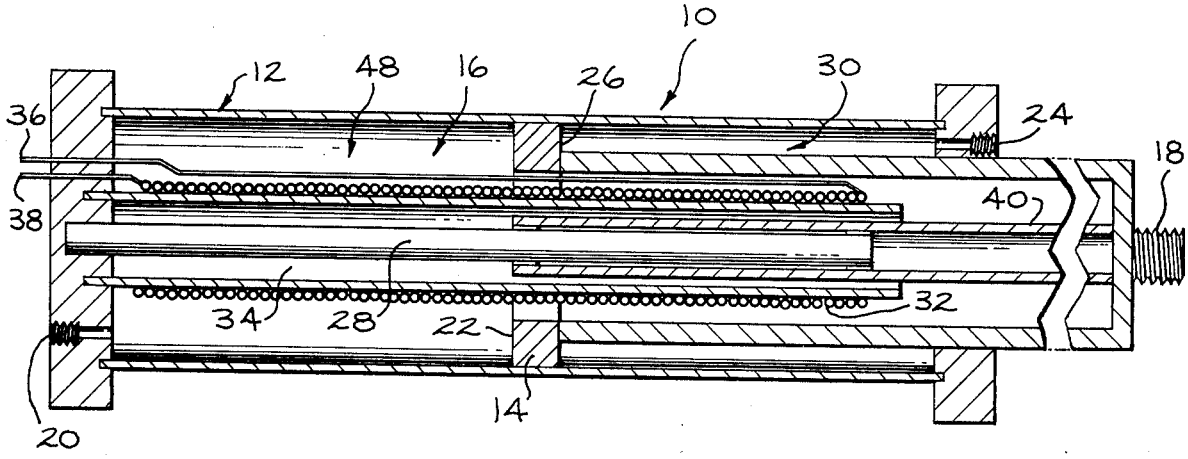
FIG. 2 is a diagrammatic, partially sectioned view of another embodiment of the improved cylinder of this invention.

In the embodiment of FIG. 2, the core element and the electrical coil 32 are fixedly connected to a common end of the housing 12. The piston 14 extends substantially coaxially about the electrical coil in the second annulus 48 and the actuating element is connected to the piston 14, extends through the housing chamber 16, and through the housing 12. The shield 40 in this embodiment is connected to the actuating element 18 for extending and retracting the actuating element 18 from and toward the housing and the shield 40 relative to the electrical coil 32 in response to movement of the piston 14.

In the operation of the control cylinder of this invention, a change of the position of the piston 14 within the housing 12 changes the amount of electrical coil 32 that is exposed to the core element 28. As that amount of exposed electrical coil changes, the signal delivered through the leads 36, 38 changes. As is known in the art, the signal delivered by leads 36, 38 can be compared to a set point signal and the difference between the delivered signal and the set point signal utilized to control passage of fluid through ports 20, 24 for positioning of the actuating element 18.

Other modifications and alterations of this invention will become apparent to those skilled in the art from the foregoing discussion, and it should be understood that this invention is not to be unduly limited thereto.

What is claimed is:

1. An improved servomechanism control cylinder having a housing, a piston movable within a chamber of the housing, an actuating element connected to the piston, means for passing fluid into the housing chamber between one end of the housing and one end of the piston, and means for passing fluid into the housing chamber between an opposed end of the housing and an opposed end of the piston for controllably moving the piston along the length of the housing, the improvement comprising:

a magnetic core element substantially coaxially positioned within the housing chamber attached to said piston;

said actuating element attached to the opposite end of said core to transmit motion to and from said piston;

an electrical coil positioned substantially coaxially about the core element between said core element and said housing and being fixed relative to the housing, said electrical coil being located adjacent one end of said cylinder and being generally about one-half the length of said core element;

a shield being generally about one-half the length of and positioned about the core element and being connected to the piston for movement along the coil in response to movement of the piston; and means connected to the electrical coil for delivering a signal responsive to the position of the shield relative to the electrical coil.

2. Apparatus, as set forth in claim 1, wherein the core and the shield are fixedly connected to a common surface of the piston and said core is connected to the actuating element for extending and retracting the actuating element from and toward the housing in response to movement of the piston.

3. Apparatus, as set forth in claim 2, wherein the piston is positioned in a first end portion of the housing chamber, the electrical coil is positioned in a second end portion of the housing chamber, and including a piston stop element positioned between the first and second end portions of the housing chamber in a pathway of the piston moving through the piston housing.

4. Apparatus, as set forth in claim 3, wherein the stop element is a tubular member fixedly connected to the housing.

* * * * *